US005803774A

United States Patent [19]

White

[11] Patent Number: 5,803,774

[45] Date of Patent: Sep. 8, 1998

[54] INTEGRATED SYSTEM FOR LAND AND WATER RECREATION

[76] Inventor: Robert D. White, P.O. Box 334, Newton, Ill. 62448-0334

[21] Appl. No.: 755,106

[22] Filed: Nov. 22, 1996

[51] Int. Cl.[6] ..... B63H 21/175

[52] U.S. Cl. ..... 440/12; 440/30; 114/61

[58] Field of Search ..... 440/21, 29, 30, 440/31, 56, 12; 114/61, 352, 344; 224/924; 280/414.1, 414.2

[56] References Cited

U.S. PATENT DOCUMENTS

| | | | |
|---|---|---|---|
| 1,034,278 | 7/1912 | Munsen . | |
| 2,296,147 | 9/1942 | Cremer | 440/30 |
| 2,536,152 | 1/1951 | Bass | 114/344 |
| 3,045,263 | 7/1962 | Blachy | 114/352 |
| 3,352,276 | 11/1967 | Zimmerman . | |
| 3,570,436 | 3/1971 | Vasseur . | |
| 3,709,185 | 1/1973 | Hennel . | |
| 3,752,111 | 8/1973 | Meynier, Jr. | 440/56 |
| 3,826,216 | 7/1974 | Rhody | 440/12 |
| 3,982,495 | 9/1976 | Hill . | |
| 4,023,222 | 5/1977 | Selby | 114/344 |
| 4,023,795 | 5/1977 | Pauls . | |
| 4,092,945 | 6/1978 | Ankert et al. . | |
| 4,170,188 | 10/1979 | Jamison, Jr. | 440/30 |
| 4,285,674 | 8/1981 | Chew . | |
| 4,406,239 | 9/1983 | Enzmann | 114/61 |
| 4,427,392 | 1/1984 | Schneider . | |
| 4,754,998 | 7/1988 | LeJuerrne | 280/414.1 |
| 5,011,441 | 4/1991 | Foley et al. | 440/30 |
| 5,224,886 | 7/1993 | Cunnningham . | |
| 5,377,886 | 1/1995 | Sickler | 224/924 |
| 5,387,140 | 2/1995 | Cunningham . | |
| 5,547,406 | 8/1996 | White . | |

FOREIGN PATENT DOCUMENTS

| | | | |
|---|---|---|---|
| 815307 | 7/1949 | Germany | 440/30 |

*Primary Examiner*—Ed L. Swinehart
*Attorney, Agent, or Firm*—Patterson & Streets, L.L.P.

[57] ABSTRACT

An integrated system for land and water recreation such that when in a flotation mode, a propeller and rudder are powered and controlled by a standard bicycle; that when in a terrestrial mode, the integrated system is powered and trailered by the same bicycle. The flotation device having a propeller drive assembly and steerable rudder for use with any standard bicycle frame allowing an individual the ability to have a self-propelled water craft. The device utilizes a standard bicycle, having only the wheels removed, to provide power and steering. The bicycle is mounted to the flotation device with the chain wrapped around the chain drive sprocket of the propeller drive assembly. Because the chain drive sprocket is a standard Shimano sprocket, the bicycle's rear derailleur may be used to shift gears. The operator may pedal the device across a body of water, then remove the bicycle frame and remount the tires to continue travel over land.

The integrated system comprises a tongue and hitching apparatus for connecting a flotation device to a bicycle; and a retractable wheel assembly for transporting the flotation device over land. In a preferred embodiment, a pair of yolks is provided for supporting detached bicycle wheels, when the integrated system is in a flotation mode.

9 Claims, 4 Drawing Sheets

INTEGRATED SYSTEM FOR LAND AND WATER RECREATION

BACKGROUND OF THE INVENTION

1. Field of the Invention

The present invention relates to an amphibious device designed to be propelled by pedaling. More particularly, the invention relates to an integrated system for land and water recreation providing a flotation mode in which, a propeller and rudder are powered and controlled by a standard bicycle, and a terrestrial mode, in which the integrated system is powered and trailered by the same bicycle.

2. Background of the Related Art

The development of individual pedal-powered flotation devices began at least as early as 1967, when Zimmerman (U.S. Pat. No. 3,352,276) was issued. Zimmerman discloses a pontoon boat having a seat, pedals and handlebars, each uniquely designed for use on the boat, attached in a configuration similar to a bicycle. However, the seat, pedals and handlebars were dedicated for use with the pontoon boat and could not be used with a functioning bicycle. Furthermore, the entire device had to be carried to the water for use. If the user did not live adjacent to a body of water, a truck would presumably have been required to transport the device.

Hennel (U.S. Pat. No. 3,709,185) discloses an amphibious motorbike capable of operating on land and carrying the necessary equipment for traveling over water. Before traveling over water, sectionalized pontoons are taken from the side carriers to be assembled and inflated. A water paddle is mounted onto the rear wheel to be rotated thereby and thus propel the motor bike over the water. Steering is controlled by the front handlebars after a rudder swings downward into place below the front wheel. However, this water-going vessel is not very maneuverable.

Hill (U.S. Pat. No. 3,982,495) discloses a bicycle powered boat having an integrated, hydrodynamically shaped hull comprising forward and rear hull sections uniquely designed to be secured to and driven by a conventional bicycle. Both hull sections can be mounted on and carried on a rear bicycle carrier or be removed from the bicycle entirely to allow land use.

Ankert et al. (U.S. Pat. No. 4,092,945) discloses a float for attachment to the frame and axles of a standard bicycle. The bicycle pedals are provided with paddle means and the front wheel is provided with a rudder. However, there is no provision for carrying the floats on the bicycle for transport over land.

Chew (U.S. Pat. No. 4,285,674) discloses a float for a standard bicycle, that permits use of the bicycle on land and in the water without removal of certain attached floats. This is accomplished by allowing the bicycle wheels to extend below the lower surface of the pontoons. The front wheel is provided with a solid circular disc to act as a rudder and the spokes of the back wheel have impeller cups or vanes attached thereto to provide thrust. Such an apparatus is quite cumbersome.

Musen (U.S. Pat. No. 1,034,278) discloses a bicycle intended for amphibious use, having front and rear floats which can be swung upwardly when the bicycle is to be used for land operation.

Despite the above attempts to provide a bicycle powered device for amphibious use, there remains a need for an improved device providing greater efficiency of effort, increased power and thrust, and greater maneuverability. It would be desirable if the device would allow for the use of a standard bicycle already owned by the operator. Furthermore, it would be desirable if the device could be combined into an integrated system for land and water recreation, such that when in a flotation mode, a propeller and rudder are powered and controlled by a standard bicycle, and when in a terrestrial mode, the integrated system is powered and trailered by the same bicycle. Furthermore, it would be desirable if the apparatus could be applied to other flotation and trailering devices.

SUMMARY OF THE INVENTION

The present improved invention provides an integrated system for land and water recreation comprising a tongue and hitching apparatus for connecting a flotation device to a bicycle and a retractable wheel assembly for transporting the flotation device over land. In a preferred embodiment, a pair of supporting yolks is provided for storing detached bicycle wheels, when the integrated system is in a flotation mode with the bicycle mounted to the flotation device.

In one aspect of the invention, the tongue and hitching apparatus comprises an elongate member having a first end connecting to the flotation device, preferably releasably or hingedly attaching to the front crossbar, and a second end having an attachment device. A hitch is coupled to the trailing end of a bicycle and is designed to releasably accept the attachment device. It is preferred that the elongate member be releasably attached to the front crossbar with a quick release mechanism.

In a second aspect of the invention, a retractable wheel assembly is provided having an axle rotationally coupled to the pontoon, first and second arms having first ends attached to the axle and second ends securing a wheel therebetween, and a lever connecting to the axle for retracting the wheel and fixing the wheel in a given position. The lever includes a hand-operated latch for fixing the retractable wheel assembly in a downward land-mobile position, an intermediate launching position, or an upward water-mobile position. Two retractable wheel assemblies are provided on opposite sides of the flotation device to allow trailering.

In yet another aspect of the invention, a pair of upwardly extending yolks is provided for storing detached bicycle wheels when the integrated system is in a flotation mode. Each yolk comprises a base portion extending upward from the rear crossbar and a pair of forks extending upwardly from the base portion for receiving a bicycle wheel. Preferably, each fork has an aperture for accepting a pin through the apertures and fixing a bicycle wheel through its hub.

The integrated system of the present invention is a completely self-contained amphibious system. On land, a standard bicycle powers and trailers the integrated system with the tongue and hitching apparatus connecting the flotation device to the bicycle. The two retractable wheel assemblies are placed in the downward position so that the flotation device effectively becomes a light-weight trailer.

On water, the standard bicycle powers the integrated system by connection to a propeller drive assembly mounted on the flotation device. The two retractable wheel assemblies of the flotation device are placed in the upward position, preferably with the wheels being above the waterline of the flotation device. The detached bicycle wheels may be temporarily coupled into a pair of supporting yolks. The entire process for changing from land to water mode and back only takes a few minutes, requires no tools, and is easily within the capability of an average person.

In another preferred embodiment, the tongue and hitching apparatus and the retractable wheel assemblies can be used in conjunction with any suitable flotation or trailering device, such as a canoe or fishing boat, and any suitable means for propulsion on land, such as a bicycle or automobile.

BRIEF DESCRIPTION OF THE DRAWINGS

So that the above recited features and advantages of the present invention can be understood in detail, a more particular description of the invention may be had by reference to a preferred embodiment thereof which is illustrated in the appended drawings. It is to be noted, however, that the appended drawings illustrate only a typical embodiment of this invention and is therefor not to be considered limiting of its scope, for the invention may admit to other equally effective embodiments.

DETAILED DESCRIPTION

The present invention provides a retractable wheel assembly and a tongue and hitching assembly for use with a flotation device, preferably the self-propelled water craft disclosed in U.S. Pat. No. 5,547,406, commonly owned by the present applicant, which patent is incorporated herein by reference. This human powered water craft provides a flotation device for use with any standard bicycle frame. This craft comprises a pair of pontoons connected by front, middle and rear crossbars, wherein the pontoons have sufficient buoyancy to allow a standard bicycle frame and rider to maintain their balance on a surface of water.

A steering mechanism is provided including a steering pivot attached to the front crossbar and a steering shaft extending upward through the steering pivot. The steering shaft has an upper end with a yoke for disconnectable attachment to the front forks of a standard bicycle frame and a lower end having a front bellcrank arm with a distal end. The craft also includes rudder pivotally coupled to the rear crossbar and includes rudder blade and a rear bellcrank arm with a distal end, wherein the rear bellcrank arm and the front bellcrank arm extend to opposite sides of the flotation device. A rigid steering link having a first end pivotally coupled to the distal end of the front bellcrank arm and a second end pivotally coupled to the distal end of the rear bellcrank arm is provided so that the flotation device is steered in the same direction that the bicycle handlebars are turned.

Left and right rear mounting brackets are attached to the middle crossbar for coupling with the rear axle slots of the bicycle frame. Together, the yoke assembly and the rear mounting brackets support the bicycle frame in an upright position. A propeller drive assembly is also provided and includes a transverse axle disconnectably connected to the rear mounting brackets; a drive gear assembly mounted concentrically about the axle comprising a chain sprocket cluster rigidly coupled to an upper drive belt sprocket and first and second bearings fixed at opposite ends of the assembly and engaging the axle to allow the assembly to spin freely about the axle; a rigid, water-tight housing downwardly depending from the axle having an inner wall; a lower bearing attached to the inner wall of the housing and having a rearwardly extending axis of rotation; a propeller shaft extending through the lower bearing having a propeller attached to a first end and a lower drive belt sprocket coupled to a second end; a drive belt frictionally engaging the upper and lower drive belt sprockets; upper and lower idlers secured adjacent the upper and lower drive belt sprockets respectively; and wherein the chain sprocket cluster is freely accessible for engagement with a bicycle chain so that pedaling the bicycle causes the propeller to push the flotation device forward.

Figure 1:
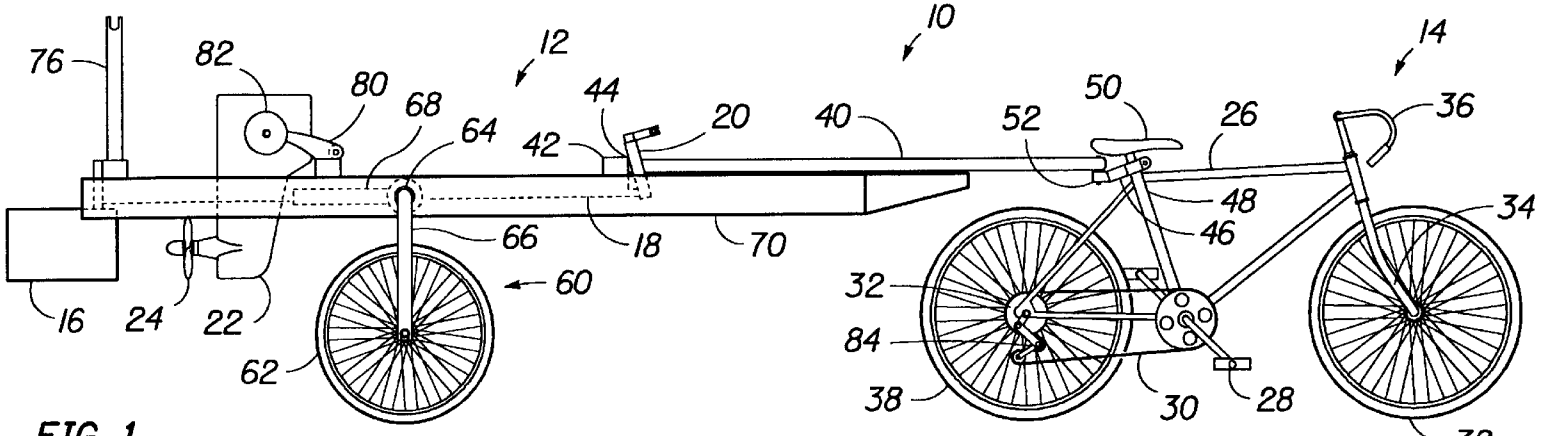
FIG. 1 is a side view of an amphibious vehicle in a land-mobile configuration.

Referring to FIG. 1, an amphibious vehicle 10 is shown configured in a land-mobile mode. The vehicle includes a flotation device 12 being pulled by a standard bicycle 14. The floatation device 12 is generally equipped with a steering mechanism, preferably including a rudder 16, steering link rod 18 and a yoke 20, and a propeller drive assembly 22 having a propeller 24. The standard bicycle 14 includes a frame 26, pedals 28, chain 30, a rear sprocket 32, a front fork 34, handlebars 36 and two wheels 38.

However, in accordance with the present invention, the amphibious vehicle 10 includes a hitching assembly comprising a tongue 40 disconnectably connected to the crossbar 42, preferably by a quick-disconnect coupling 44. The distal end of the tongue 40 is also disconnectably connected to a hitch 46 which is mounted to the bicycle 14. The hitch 46 may be mounted to various points on the bicycle so long as the bicycle can still be turned without interference from the tongue. It is preferred that the hitch 46 be coupled to the vertical post 48 below the bicycle seat 50. In this manner, as the bicycle turns the rear wheel 38 passes below the tongue 40. The hitch 46 extends generally behind the post 48 to receive the tongue 40. A simple quick-disconnect 52, such as a pin removably disposed through mating holes in both the tongue and hitch, is provided which allow the tongue and hitch to pivot easily.

The amphibious vehicle 10 also has a retractable wheel assembly 60 having a wheel 62 disposed in the downwardly land-mobile position. The wheel assembly 60 has an axle 64 rotationally disposed through a portion of the flotation device 12, the axle including a fork 66 extending at a right angle from the outer end to receive the wheel 62 and a hand-latching lever 68 coupled to the inner end. The hand-latching lever 68 is used to set the elevation of the wheel 62 relative to the pontoon 70. The operation of the hand-latching lever 68 is described in greater detail with regard to FIGS. 4, 5 and 6.

Figure 2:
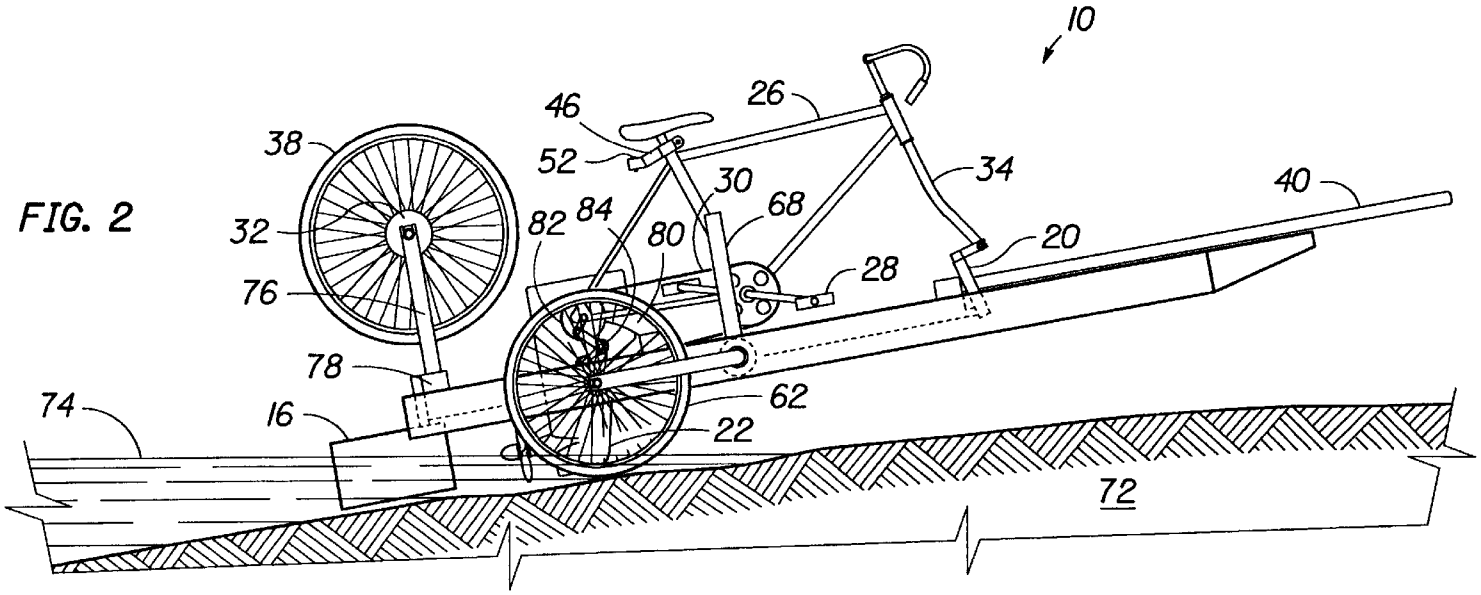
FIG. 2 is a side view of an amphibious vehicle configured for launching between land and water.

Now referring to FIG. 2, the amphibious vehicle 10 is shown configured for launching between land 72 and water 74. Notice that every component of the land-mobile mode of FIG. 1 is utilized in the configuration for launching. In particular, both wheels 38 are removed from the bicycle 14 and secured in the storage forks 76, preferably extending upward from the rear crossbar 78. The bicycle frame 26 is mounted with the front fork 34 coupled to the yoke 20 for steering and the rear axle slots are coupled to the mounting brackets 80. The bicycle chain 30 is engaged around the gear cluster 82 so that the bicycle derailer 84 is still used to shift from one gear to another. While the bicycle brakes are not used in accordance with the flotation device, it is important to note that the brakes are left in place, so that when the wheels 38 of the bicycle 14 are remounted, the bicycle is ready to ride on land.

As shown in FIG. 2, the vehicle 10 is ready for launching into the water by allowing it to slowly back down an inclined boat ramp. In a preferred embodiment, the retractable wheel assembly 60 provides an intermediate launching position in which the wheels 62 extend only slightly below the flotation device 12, thereby reducing the distance away from the boat ramp at which the device begins to float freely. The hand-latching lever 68 is shown in an upright position.

Figure 3:
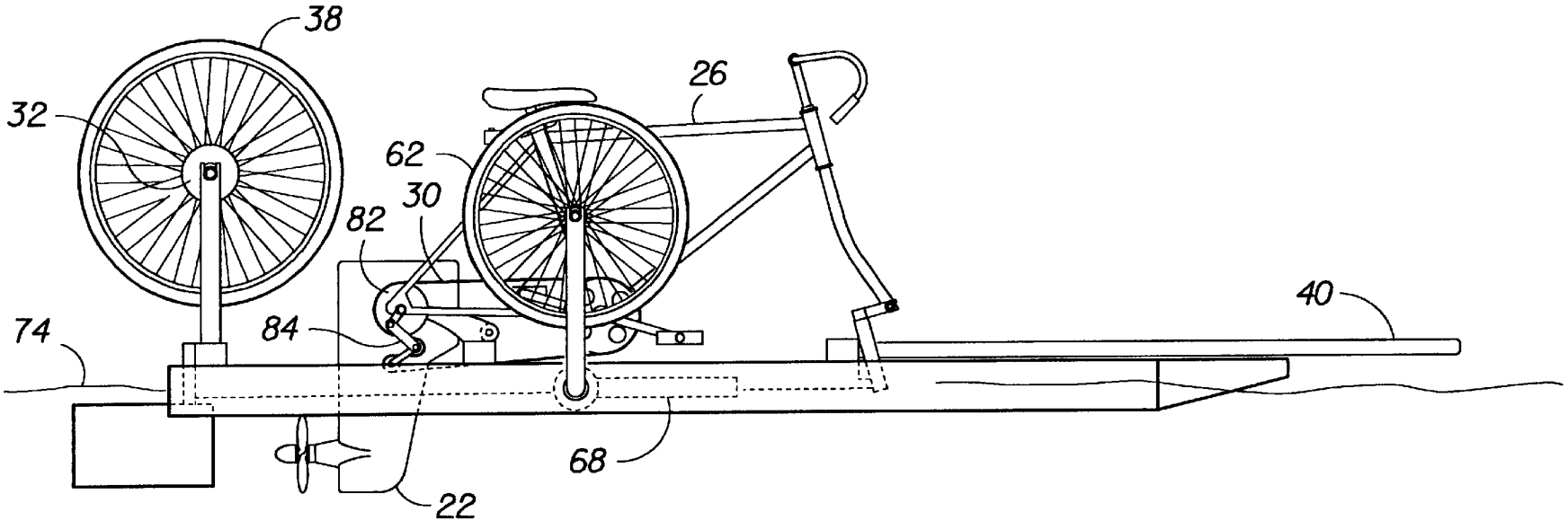
FIG. 3 is a side view of an amphibious vehicle in a water-mobile configuration.

Now referring to FIG. 3, a side view of the amphibious vehicle 10 is shown in the water flotation mode. The pontoons 70 hold the bicycle frame 26, pedals 28, chain 30 and wheels 32 substantially above the water level as the vehicle is propelled through the water. Furthermore, the hand-latching lever 68 is pressed forward and down in order to raise the retractable wheel 62 out of the water.

Figure 4:
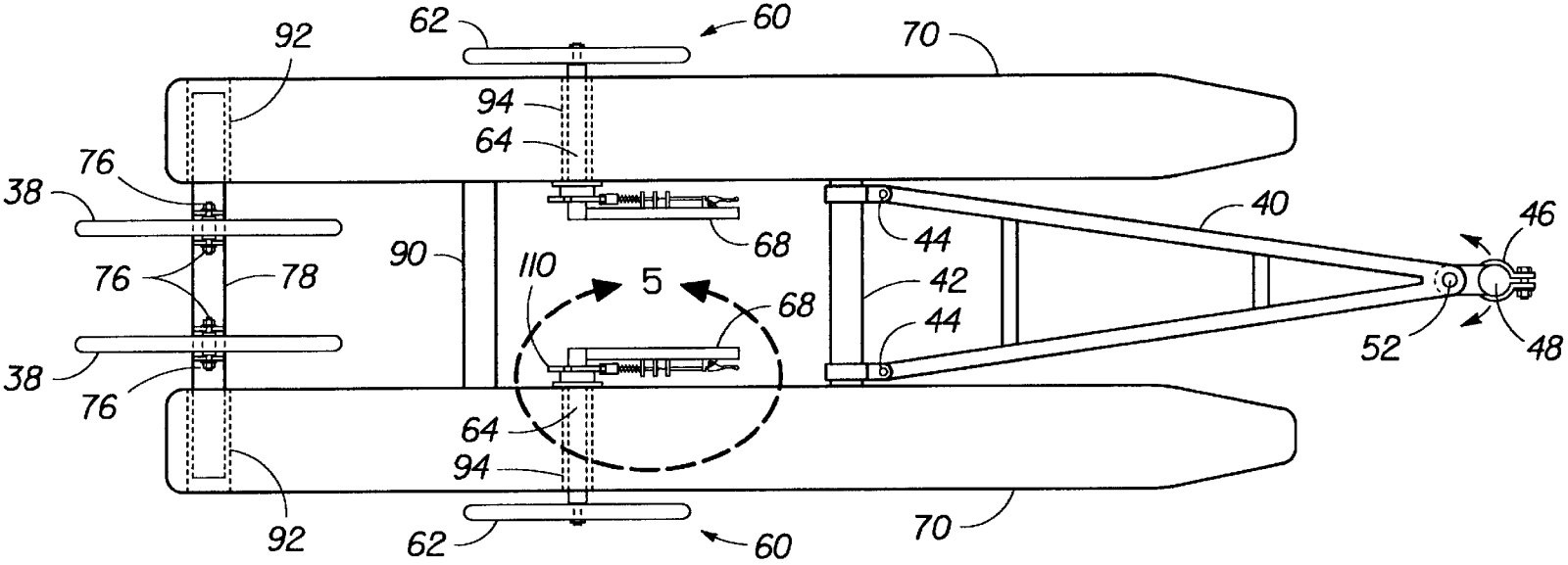
FIG. 4 is a partial top view of the amphibious vehicle having two pontoons secured together by three crossbars, a tongue and hitching apparatus, two retractable wheel assemblies and two wheel storage forks.

Now referring to FIG. 4, a partial top view of the amphibious vehicle is shown. The apparatus provides an elongate tongue 40 extending forward from the crossbar 42 by coupling to the quick disconnect couplings 44. The crossbar 42 connects the tongue 40 to the pontoons 70. The hitch 46 is secured to the vertical support 48 of the bicycle (not shown) and provides a quick disconnect coupling 52 for releasably securing the end of the tongue 40 in a pivoting relation. In one embodiment, the tongue and hitching apparatus comprises a triangular-shaped yolk 40. If the tongue 40 is detached, it is preferably stored and secured to the flotation device during the launching and water-mobile modes.

The apparatus 10 also provides yolk members 76 for supporting detached bicycle wheels 38 when the integrated system is in the launching or flotation modes. The yoke members 76 extend generally upward to keep the wheels 38 out of the way and out of the water, such as the rear crossbar 78. The axles of the wheels 38 are received in apertures formed in the end of the yolk members 76 and fastened thereto, preferably in a manner similar to how the wheels 38 are fastened to the bicycle frame 26.

Also as shown in FIG. 4, the internal crossbars 78,90,42 are coupled with the pontoons 70 and extend into the side of the pontoons 70. The internal crossbars 78,90,42 are positioned in crossbar channels 92 extending through the pontoons 70. The crossbar channels 92 preferably run perpendicular to the long axis of the pontoons 70 and sliding secure the ends of the crossbars Because the crossbars are secured into the side of the pontoons 70, the top surface of the pontoons 70 is unobstructed and can be used for other purposes, such as carrying a cooler of drinks.

A pair of retractable wheel assemblies 60 are attached to the pontoons through a pair of cylindrical transverse channels 94 (one in each pontoon 70), preferably located just slightly rearward of the flotation device's center of gravity. The hand-latching levers 68 include a latching mechanism shown more particularly in FIGS. 5 and 6.

The lever 68 is preferably connected to the axle 64 in the area between the pontoons 70 in proximity to the bicycle. The lever 68 and latching mechanism provide for the wheels 62 to be retractable and fixable in a downward land-mobile position (See FIG. 1), an intermediate launching position (See FIG. 2) or an upward water-mobile position (See FIG. 3). Alternatively, the retractable wheel assembly may be made to be infinitely adjustable.

Figure 5:
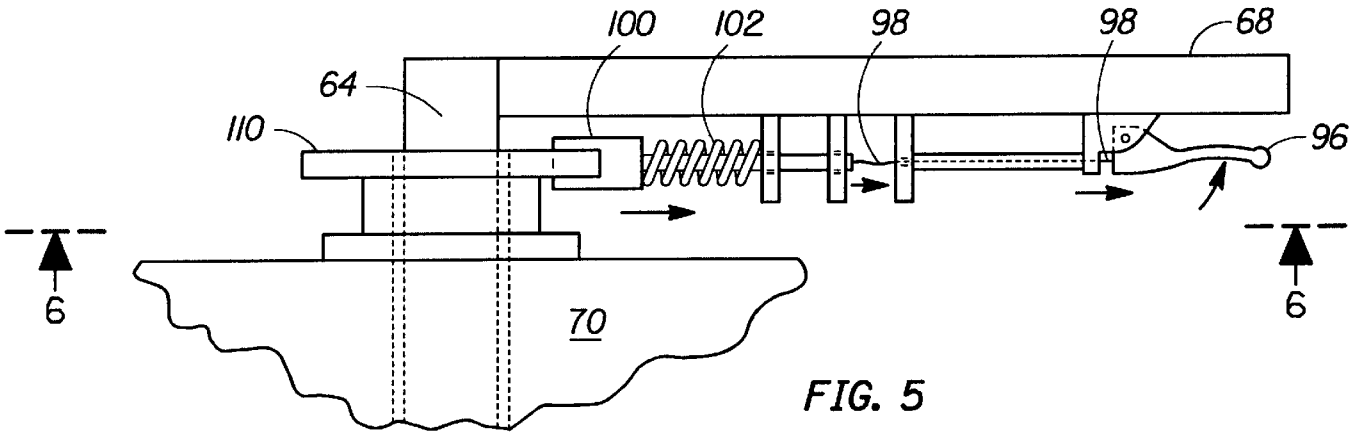
FIG. 5 is a top view of the retractable wheel assembly showing a hand latching mechanism.
Figure 6:
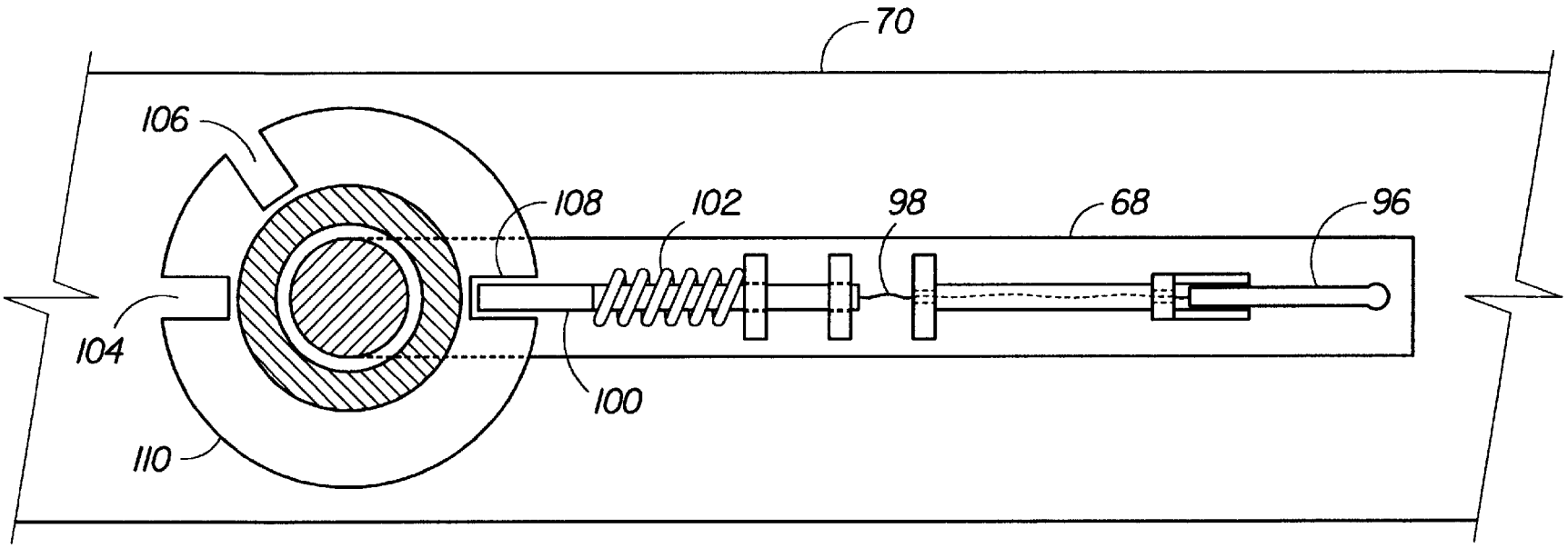
FIG. 6 is a side view of the hand latching mechanism of FIG. 5 taken along line 6—6.

Referring now to FIGS. 5 and 6, a lever 68 is shown fixedly connecting to the axle 64 and including a hand-operated actuator 96 at its distal end. The actuator 96 draws a cable 98 coupled to a latching plate 100 against the force of a spring 102. The spring 102 retains the latching plate 100 in one of the three apertures 104,106,108 formed in a rigid member 110. The three apertures 104,106,108 allow the wheel 62 to be latched in the downward position for the land-mobile mode, the intermediate position for the launching and the upward position for the water-mobile mode, respectively.

It should be noted that the flotation device, as described herein, may also be a universal platform accepting various devices for locomotion on water, including but not limited to, a standard bicycle and a human powered ski machine.

While the foregoing is directed to a preferred embodiment of the present invention, other and further embodiments of the invention may be devised without departing from the basic scope thereof, and the scope thereof is determined by the claims which follow.

I claim:

1. An amphibious transportation system, comprising:

a) a bicycle having a frame; a front fork and detachable front and back wheels, the fork being coupled to a handlebar for steering, the detachable back wheel having a sprocket coupled to a drive chain and pedals for providing a motive force to the sprocket and back wheel, and a hitch;

b) a water flotation device having a pair of pontoons, a propeller drive assembly adapted for detachably coupling with the bicycle drive chain, and a rudder assembly adapted for detachably coupling with the bicycle front fork; the pair of pontoons being attached by front, middle, and rear crossbars, the crossbars being positioned perpendicularly to the long axis of the pontoons;

c) a pair of side wheels adjustably attached to the flotation device; and d) a tongue and hitching apparatus adapted for detachably coupling the water flotation device to the bicycle hitch;

wherein the tongue and hitching apparatus further comprising:

a triangular-shaped yolk having a first frame side and a second frame side, each frame side having a first base end connecting to the flotation device and to the front crossbar;

the frame sides being connected by at least one transverse member, the frame sides tapering to form a second apex end;

the apex end ending in an attachment device; and a hitch being attached to means for propulsion on land, the hitch accepting the attachment device.

2. The amphibious transportation system of claim 1, wherein the tongue and hitching apparatus is hingeably attached to the front crossbar.

3. The amphibious transportation system of claim 1, wherein the tongue and hitching apparatus is disconnectably connected to the front crossbar by a pin removably disposed through mating holes in both the tong and the front crossbar.

4. The amphibious transportation system of claim 1, wherein the rudder assembly comprises:

a steering pivot attached to the forward end of the water flotation member;

a steering shaft extending through the steering pivot, the steering shaft comprising an upper end with a yoke for detachable coupling to the bicycle front forks and a lower end having a front bellcrank arm with a distal end;

a rudder pivotally coupled to the back end of the water flotation member, the rudder having a rear bellcrank arm with a distal end, wherein the front bellcrank arm distal end is coupled to the rear bellcrank arm distal end by a link rod so that turning the bicycle handlebars causes the system to turn in the same direction.

5. The amphibious transportation system of claim 1, wherein the steering mechanism further comprises:

a steering pivot attached to the forward portion of the flotation device;

a steering shaft extending upward through the steering pivot comprising an upper end with a yoke for disconnectable attachment to the front forks of a bicycle frame and a lower end having a front bellcrank arm with a distal end;

a rudder pivotally coupled to the flotation device rearward of the propeller comprising a rear bellcrank arm with a distal end, wherein the rear bellcrank arm extends opposite the front bellcrank arm so that the flotation device is steered in the same direction that the bicycle is turned.

6. An amphibious transportation system, comprising:

a) a bicycle having a frame; a front fork and detachable front and back wheels, the fork being coupled to a handlebar for steering, the detachable back wheel having a sprocket coupled to a drive chain and pedals for providing a motive force to the sprocket and back wheel, and a hitch;

b) a water flotation device having a pair of pontoons, a propeller drive assembly adapted for detachably coupling with the bicycle drive chain, and a rudder assembly adapted for detachably coupling with the bicycle front fork; the pair of pontoons being attached by front, middle, and rear crossbars, the crossbars being positioned perpendicularly to the long axis of the pontoons;

c) a pair of side wheels adjustably attached to the flotation device; and d) a tongue and hitching apparatus adapted for detachably coupling the water flotation device to the bicycle hitch;

wherein the side wheels are part of a retractable wheel assembly, the wheel assembly further comprising:

a pair of transverse channels, one in each pontoon;

an axle having a first and a second end, the axle passing through and extending beyond the transverse channels;

a pair of arms each having a first end attached to the first or the second end of the axle, respectively, and each having a second forked end rotatably mounted to the side wheels; and a lever and hand-braking device connecting to the middle portion of the axle and being located in a spaced area positioned between the pontoons, the lever and hand-braking device providing for the wheels being retractable and fixable in either a downwardly land-mobile position for trailering, or in an upwardly water-mobile position for boating.

7. The amphibious transportation system of claim 6, wherein the wheels are fixable in middle position for launching.

8. An amphibious transportation system comprising:

a) a bicycle having a front fork and detachable front wheel, the fork being coupled to a handlebar for steering; a detachable back wheel having a sprocket coupled to a drive chain and pedals for providing a motive force to the sprocket and back wheel, and a hitch;

b) a water flotation device having a float; a rudder assembly adapted for detachably coupling with the bicycle front fork; and a propeller drive assembly adapted for detachably coupling with the bicycle drive chain comprising:

a transverse axle disconnectably connected to the float;

a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle;

a rigid member downwardly depending from the axle;

a lower bearing attached to the rigid member and having a rearwardly extending axis of rotation;

a propeller shaft extending through the lower bearing having a propeller attached to a first end and a lower drive belt sprocket coupled to a second end;

a drive belt frictionally engaging the upper and lower drive belt sprockets;

an idler coupled to the rigid member adjacent one of the drive belt sprockets, wherein the idler is adapted to adjust the tension on the drive belt;

wherein the chain sprocket cluster is freely accessible for engagement with the bicycle chain so that turning the bicycle pedals causes the propeller to push the flotation device forward, c) a pair of side wheels attached to the float for rolling the water flotation device over land; and d) a tongue and hitching apparatus adapted for detachably coupling the water flotation device to the bicycle hitch.

9. An amphibious transportation system comprising:

a) a bicycle having a front fork and detachable front wheel, the fork being coupled to a handlebar for steering; a detachable back wheel having a sprocket coupled to a drive chain; pedals for providing a motive force to the sprocket and back wheel; and a hitch;

b) a water flotation device having a float; a rudder assembly adapted for detachably coupling with the bicycle front fork; a pair of rear mounting brackets for coupling a bicycle frame to the flotation device; and a propeller drive assembly adapted for detachably coupling with the bicycle drive comprising:

a transverse axle disconnectably connected to the rear mounting brackets;

a drive gear assembly mounted concentrically about the axle comprising a chain sprocket rigidly coupled to an upper drive belt sprocket, and first and second bearings fixed at opposite ends of the assembly and engaging the axle to allow the assembly to spin freely about the axle;

a rigid member downwardly depending from the axle;

a lower bearing attached to the rigid member and having a rearwardly extending axis of rotation;

a propeller shaft extending through the lower bearing having a propeller attached to a first end and a lower drive belt sprocket coupled to a second end;

a drive belt frictionally engaging the upper and lower drive belt sprockets;

an idler coupled to the rigid member adjacent the upper and lower drive belt sprockets respectively, wherein the idler is adapted to adjust the tension on the drive belt;

wherein the chain sprocket cluster is freely accessible for engagement with a bicycle chain so that pedaling the bicycle causes the propeller to push the flotation device forward, c) a pair of side wheels attached to the float for rolling the water flotation device over land; and d) a tongue and hitching apparatus adapted for detachably coupling the water flotation device to the bicycle hitch.

* * * * *